US008490560B2

(12) United States Patent
Walker et al.

(10) Patent No.: US 8,490,560 B2
(45) Date of Patent: Jul. 23, 2013

(54) PLASTICIZED AND ASSEMBLEABLE COVER SUCH AS FOR USE WITH WATERWAY CONSTRUCTED TRANSPORT BARGES INCLUDING STRUCTURALLY REINFORCING INNER TRUSSES, IN-MOLDED END WALL LADDER AND FOUR POINT LIFT LOCKING/UNLOCKING DOOR FOR SELECTIVELY ACCESSING A BARGE INTERIOR

(75) Inventors: Phillip Walker, Paducah, KY (US); Jeff James, Paducah, KY (US); Miguel A. Linares, Bloomfield Hills, MI (US); Warren A. Waxham, Lexington, KY (US); Michael G. Wisniewski, North East, PA (US); Brent A. Honsberger, Sugar Grove, PA (US)

(73) Assignee: Brown Water Plastics, LLC, Paducah, KY (US)

( * ) Notice: Subject to any disclaimer, the term of this patent is extended or adjusted under 35 U.S.C. 154(b) by 232 days.

(21) Appl. No.: 13/151,679

(22) Filed: Jun. 2, 2011

(65) Prior Publication Data

US 2011/0239924 A1 Oct. 6, 2011

Related U.S. Application Data

(63) Continuation-in-part of application No. 12/187,677, filed on Aug. 7, 2008, now Pat. No. 7,966,960.

(60) Provisional application No. 60/954,487, filed on Aug. 7, 2007.

(51) Int. Cl.
*B63B 19/18* (2006.01)

(52) U.S. Cl.
USPC ..... 114/202; 114/117

(58) Field of Classification Search
USPC 114/117, 201 R, 202, 203; 220/314; 296/218
See application file for complete search history.

(56) References Cited

U.S. PATENT DOCUMENTS

| | | | | |
|---|---|---|---|---|
| 3,730,128 | A | 5/1973 | Burwell | |
| 3,785,322 | A | 1/1974 | Kersteter | |
| 3,800,723 | A | 4/1974 | Collins | |
| 3,913,971 | A * | 10/1975 | Green | 296/218 |

(Continued)

FOREIGN PATENT DOCUMENTS

| | | | |
|---|---|---|---|
| JP | 55094877 | A | 7/1980 |
| JP | 62214087 | A | 9/1987 |
| WO | 2009021112 | A2 | 2/2009 |

*Primary Examiner* — Lars A Olson
(74) *Attorney, Agent, or Firm* — Gifford, Krass, Sprinkle, Anderson & Citkowski, P.C.; Douglas J. McEvoy

(57) ABSTRACT

A cover for use with an elongated opening associated with a transportable barge. The cover includes a number of inter-engageable cover sections, each exhibiting a plasticized construction and extending in both widthwise and lengthwise fashion relative to an upper lip edge defining an open perimeter of the barge. Each cover section exhibits pairs of opposing lifting eyes and associated locking pins, these being defined along outer extending side edge locations of each cover section and is adapted to securing the cover section upon the barge perimeter defining edge. Each cover further includes a four point locking and unlocking feature activated by a lift handle for selectively opening a cargo carrying interior associated with the barge. A plurality of structurally strengthening trusses are also incorporated into each individually assemble-able barge section in combination with an in molded ladder associated with each end wall section.

16 Claims, 10 Drawing Sheets

U.S. PATENT DOCUMENTS

| | | | | |
|---|---|---|---|---|
| 4,130,125 | A | | 12/1978 | Nivin |
| 4,237,809 | A | | 12/1980 | Hickmann |
| 4,239,008 | A | | 12/1980 | Conlon |
| 4,394,044 | A | * | 7/1983 | Hough et al. ..... 296/218 |
| 4,461,232 | A | | 7/1984 | Berg |
| 4,537,147 | A | | 8/1985 | Nivin |
| 5,322,405 | A | | 6/1994 | Swensson et al. |
| 5,380,058 | A | | 1/1995 | Short et al. |
| 5,441,005 | A | * | 8/1995 | Freeman et al. ..... 114/117 |
| 5,778,815 | A | | 7/1998 | Shields et al. |
| 5,850,799 | A | | 12/1998 | Geisel et al. |
| 5,931,111 | A | | 8/1999 | Shields et al. |
| 6,016,761 | A | | 1/2000 | Berg, Sr. |
| 6,109,283 | A | | 8/2000 | Burke et al. |
| 6,138,597 | A | | 10/2000 | Berg, Sr. |
| 6,161,493 | A | | 12/2000 | Berg, Sr. |
| 6,352,046 | B1 | | 3/2002 | Berg, Sr. et al. |
| 6,443,084 | B1 | | 9/2002 | Berg, Sr. et al. |
| 6,516,740 | B2 | | 2/2003 | Berg, Sr. et al. |
| 2002/0189519 | A1 | | 12/2002 | Berg et al. |

* cited by examiner

PLASTICIZED AND ASSEMBLEABLE COVER SUCH AS FOR USE WITH WATERWAY CONSTRUCTED TRANSPORT BARGES INCLUDING STRUCTURALLY REINFORCING INNER TRUSSES, IN-MOLDED END WALL LADDER AND FOUR POINT LIFT LOCKING/UNLOCKING DOOR FOR SELECTIVELY ACCESSING A BARGE INTERIOR

CROSS-REFERENCE TO RELATED APPLICATIONS

This application is a continuation in part of U.S. patent application Ser. No. 12/187,677 filed Aug. 7, 2008 and entitled Plasticized and Assembleable Cover Such as for Use with Waterway Constructed Transport Barges.

FIELD OF THE INVENTION

The present inventions collectively disclose a multi-piece, plasticized, and buoyant cover for use with a waterway transport barge, commonly termed a hopper barge and which is capable of carrying large volumes of loose granular materials, such as fertilizers, grains and the like. Assemble able components define a plurality of individual and alternating (i.e., male/female/end) lid sections associated with a conventional sized transport barge, these further being aerodynamically constructed, ventilated and stackable. Additional features associated with the design include such as textured/non-slip surfaces and integrally defined stairways defined in end wall sections. Each cover section further includes a plurality of integrally formed support trusses, along with each cover section also including a pair of roller supported doors with four point locking and unlocking features activated by a lift and translate handle.

BACKGROUND OF THE INVENTION

The prior art is well documented with examples of barge cover assemblies. An objective of known cover assemblies is to protect items carried within a cavity defined body of a transport barge supported upon a body of water.

An objective of such barge covers is to enable them to be more easily lifted off from the an open perimeter defining location established by the barge. One example of a such a hopper barge cover is disclosed in U.S. Pat. No. 4,237,809, issued to Hickmann, and which includes a plurality of linearly telescoping cover portions (housings), terminating in a central most and highest housing (i.e., both ends displace progressively inwards to a central location). The central housing exhibits a transverse plate extending across it at the center of its length. The outermost housing is driven at each end separately with the other housings having cooperating elements to engage each other to cause the housings on each side of the transverse plate of the central housing to sequentially move in or out with respect to the central housing. All of the housings have glides or wheels on each side for riding on flat surfaces supported on opposing sides of the barge.

Geisel, U.S. Pat. No. 5,850,799, teaches a portable barge cover incorporating a removable and storable covering system including several overlapping flexible sheets places over spaced apart arched members and which span from one side of a hold to the opposite side. The flexible sheets are secured by several straps that cross over the flexible sheets trapping the sheet between the strap and the arched member.

U.S. Pat. Nos. 6,016,761, 6,138,597 and 6,161,493, to Berg, Sr., each disclose a lift-off cover assembly for barges which includes adjacently positioned and curved cover sections and end cover sections located at opposite ends of the adjacently positioned curved cover sections. The cover assembly includes a central walkway which extends between openings on the cover assembly and climbing stairs which are positioned so as to facilitate the travel of a cargo loading operated towards the openings. Each of the openings further includes cover members, such as lids or doors, which have handles or latches that are accessible from the central walkway.

Finally, additional U.S. Pat. Nos. 6,352,046 and 6,443,084, also to Berg, Sr., each disclose a variation of a telescoping and rolling cover assembly for a barge and which includes a plurality of cover sections, such as constructed of fiber reinforced plastic, and which travel along a track or tracks provided upon an associated barge coaming. The cover sections are provided with anti-derailment tracks that engage a vertical lip of the barge coaming to prevent the covers from being pulled off the track. The clamps are further provided with wind latch extensions to secure the cover sections in a stacked position. The cover sections may be provided with a stacking shelf that provides a surface on which an overlying stacked cover may rest, and may further travel along one or more tracks provided on the sides of the barge coaming. A portion of some cover sections may travel along tracks attached to underlying cover sections.

SUMMARY OF THE INVENTION

The present invention discloses an improved cover for use with an elongated opening associated with a transportable barge, and includes a number of inter-engageable cover sections, each exhibiting a lightweight plasticized construction supported by a plurality of aluminum trusses and extending in both widthwise and lengthwise fashion relative to an upper lip edge defining an open perimeter of the barge. Each cover section exhibits pairs of opposing lifting eyes and associated locking pins, these being defined along outer extending side edge locations of each cover section and is adapted to securing the cover section upon the barge perimeter defining edge.

At least one, and typically a pair, of roller supported and traversable doors are incorporated into each cover section, with each incorporating a four point locking and unlocking feature which interfaces with a pivotal handle for rotating open (unlocking) in a first position and rotating closed (locking) in a second position. Upon being rotated open, the handle and associated door can be pushed/pulled in a desired opening or closing direction in order to selectively access a cargo carrying interior associated with the barge.

Additional features include the cover sections being provided as first and second end sections, with intermediately defined and alternating female and male sections arranged in joint abutting fashion between opposite ends of barge perimeter opening, with the end walls associated with each end section plastic welded and bolted to associated end wall joints. A ladder is in-molded into a vertically extending end wall section, this including projecting sides defining a vertical access channel across which is secured metal step rods in vertically spaced and ascending fashion, so as to assist a user in gaining access to a top surface of the cover.

The cover sections further each exhibit a specified shape and size with an arcuate extending upper edge into which is integrally formed a stairway leading to each traversable supported door. In a preferred variant, each cover section includes a pair of supported doors and integrally defined stairways extending in spaced apart and width extending fashion between first and second sides.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
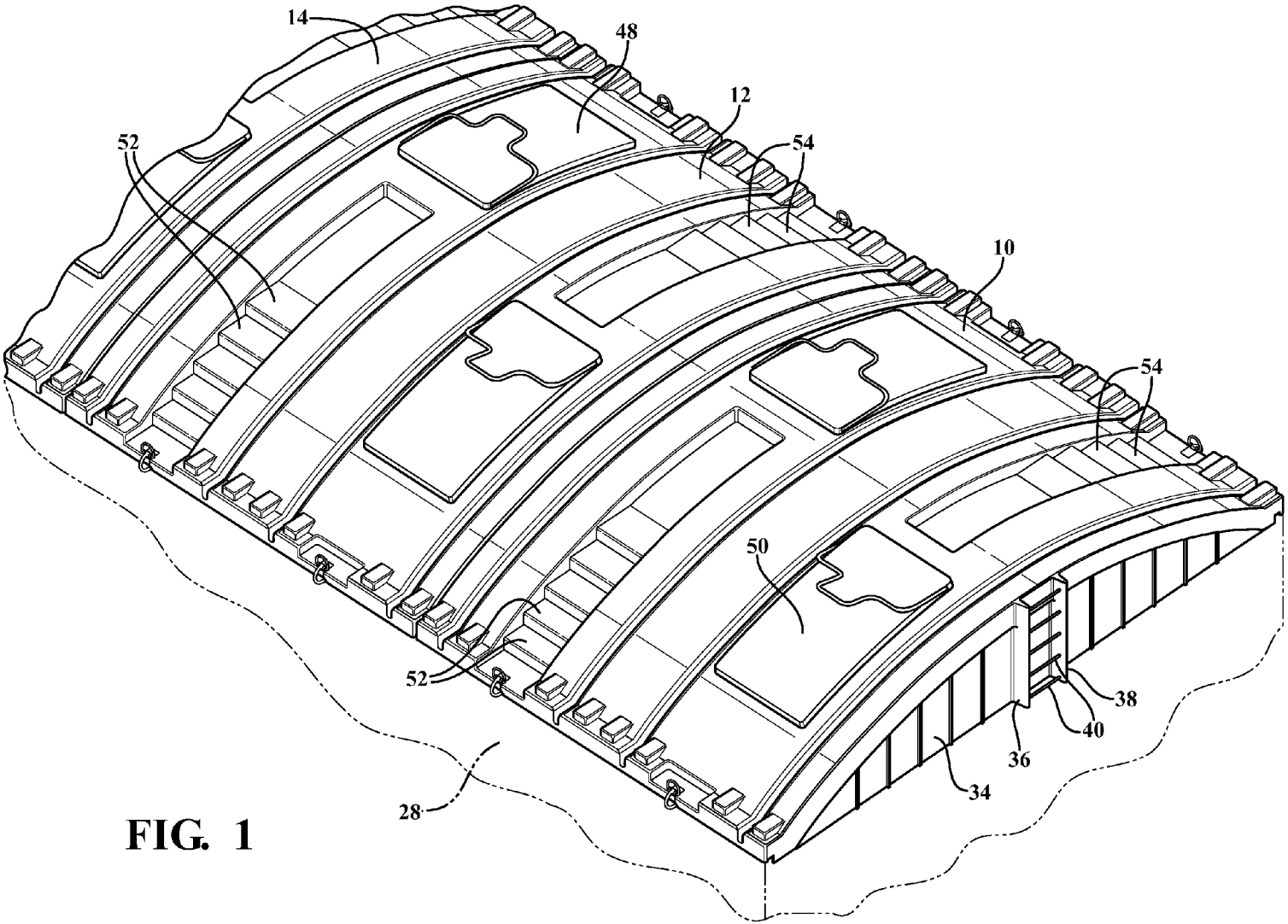
FIG. 1 is a perspective view of the assembleable cover and illustrating a sub-plurality of female/male/end sections which are secured over an open top of a conventional waterway transportable barge.

Referring now to the drawing illustrations, a series of perspective, plan and cutaway views are shown of a multi-piece, plasticized, and buoyant cover for use with a waterway transport barge, and such as in particular a hopper barge carrying large volumes of loose granular materials, such as fertilizers, grains and the like.

As will further be described, the assembleable components define a plurality of individual and alternating (i.e., male/female/end) lid sections, these associated with a conventional sized transport barge. This is depicted in top plan view in FIG. 7 according to one non-limiting variant and includes a selected plurality of nine individual opposing edge interlocking cover sections including first end wall section 10, male section 12, female section 14, male section 16, female section 18, male section 20, female section 22, male section 24 and, finally, second end wall section 26.

The lid/cover sections are aerodynamically constructed from such as typically a recyclable, lightweight plastic and/or powder impression formed material (incorporating such as an entrained aggregate material of desired composition) and, as will be further described in additional detail, can incorporate such as lightweight aluminum reinforcing trusses to enhance strength. The construction of each section is such that it exhibits buoyant characteristics when placed within a body of water and, when assembled in place over an associated defined inner perimeter and coaming associated with the cargo containing barge, exhibits both inner-ventilating and moisture impervious aspects for the transport barge.

As will also be described, each cover section further includes one or more (typically a pair) of roller supported doors exhibiting pivoting unlock/lock handles which facilitate four point contact with upper surface locations of cover section located proximate the perimeter defining access aperture. Additional features associated with the design also include such as textured/non-slip surfaces, integrally defined stairways leading to the access doors, and pairs of side disposed lifting eyes. The lifting eyes, in combination with rotatably displaceable engaging pins associated with an upper lip edge location of the cover, allow a given cover section to be engaged and removed by a crane.

Referring again to FIG. 1, a perspective view is shown generally of a portion of the assembleable cover secured atop a conventional and waterway transport barge, the general outline of which is depicted in phantom at 28. The cover in FIG. 1 is illustrated by a sub-plurality of end wall 10, male 12 and female 14 interlocking sections, these being interengaged together and secured over an open perimeter defined top (the associated inner coaming edge of which is not illustrated) of a conventional waterway transportable barge 18.

Figure 7:
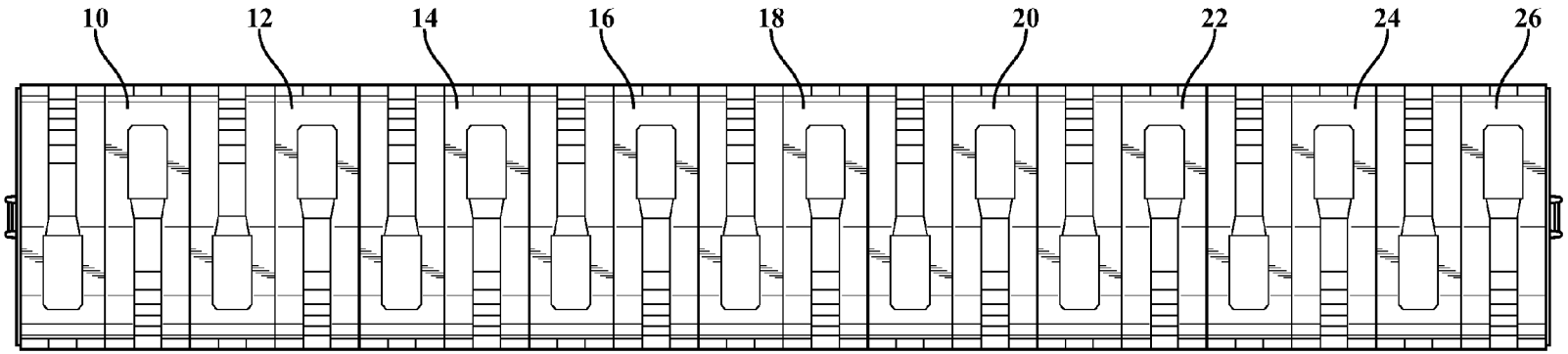
FIG. 7 is a top plan view corresponding to FIG. 1 and depicting one environmental application of a plurality of assembleable cover sections such as which are secured over an existing waterway transportable barge.

Beyond the plurality of nine (9) interconnecting sections depicted in the variant of FIG. 7, it is further understood that any other number of cover sections can be are arranged in lengthwise extending and interlocking fashion for spanning a distance associated with any suitably dimensioned conventional waterway transport barge 18. It is further envisioned that the cover sections can also be provided according to either of customized dimensions for engaging a selected barge configuration or any standardized set of length, width and height dimensions, such as to provide a suitable covering to any class of transport barge exhibiting which may exhibit a standardized upper rim seating profile. Among these possible alternate variants are cover sections ranging from a single section for covering a smaller sized perimeter opening of a likewise smaller sized barge or other smaller sized shipping container and up to any number of interconnecting sections for accommodating any lengthened configurations of barge perimeter defined opening such that the cover section or sections each exhibit specified length and width defining characteristics matching that of the defined perimeter opening of the barge or container opening and further such that the underside support surfaces (three sided with respect to the end wall sections and two sided with further respect to the male/female interconnecting sections) of each section shoulder upon a corresponding ledge of the barge established in perimeter extending fashion about the opening.

Although the barge is only illustrated representatively in certain illustrations, such as again at 28 in FIG. 1, it is understood that a variant of the present invention operates with a conventional hopper barge, approximately 175' feet in overall length and 35' in width, and particularly suited for transporting upon waterways such as loose granulate cargoes including fertilizers, grains and the like. That said, it is understood that the barge cover is capable of being employed with any open topped and three-dimensional cargo carrying body, this including land freight (e.g. train and truck) enclosures, as well as potentially air freight enclosures.

Figure 2:
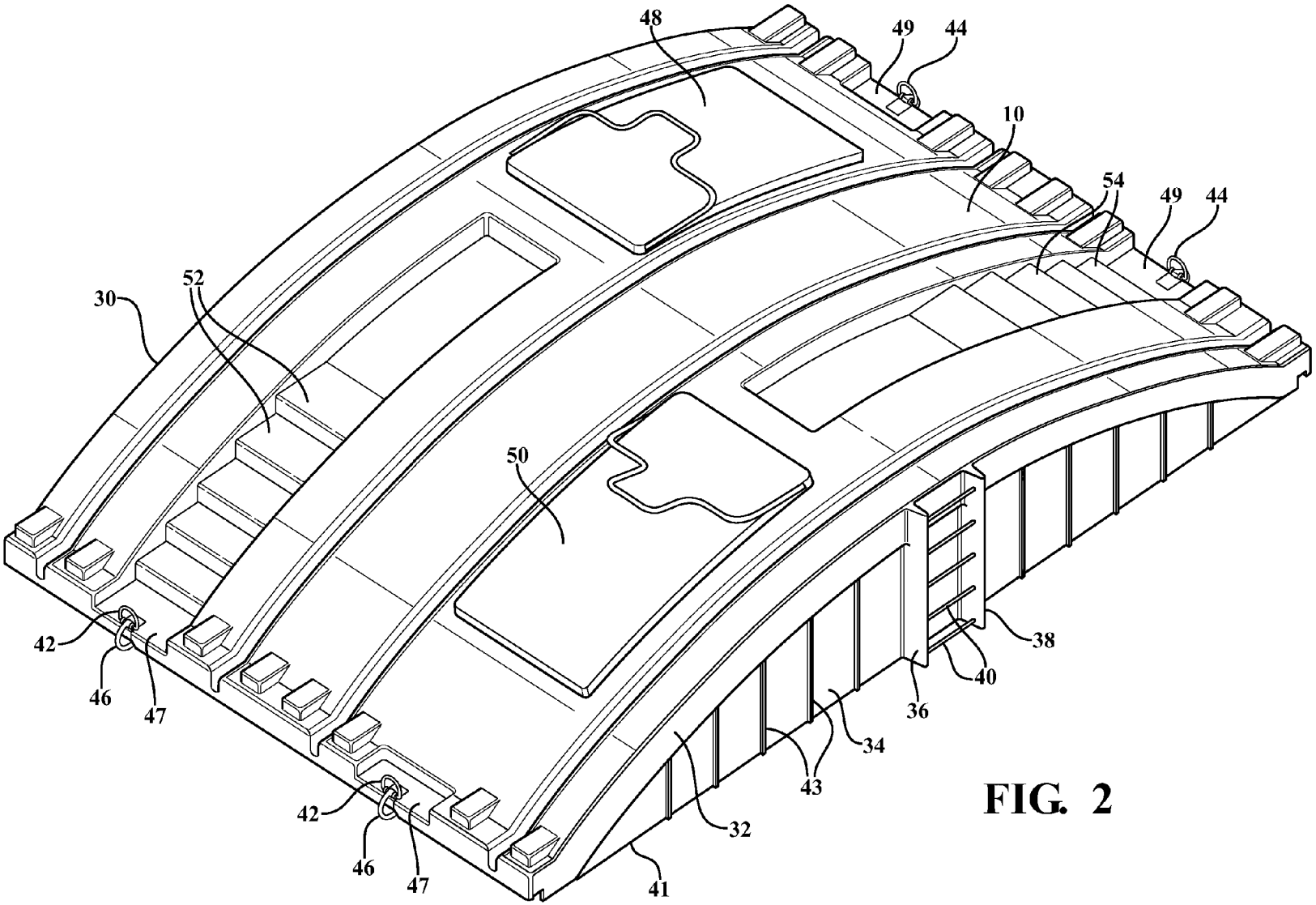
FIG. 2 is an enlarged illustration of the end section of the assembleable cover illustrated in FIG. 1.

Referencing FIG. 2, an enlarged and partially rotated perspective view is depicted of end wall (lid) section 10 and includes an arcuate extending body with a first widthwise extending edge 30 (this interconnecting with an opposing and adjoining edge associated with the male cover section 12 shown in FIG. 1) as well as a second opposite widthwise extending edge 32. An end wall encloses an open underside revealed by the edge 20, and relative to an end-extending supporting wall of the barge or other suitable cargo carrying article. The end wall includes a substantially three-sided (considering the upper arcuate edge as defining a single side) shape 34 and further exhibits an in-molded ladder defined by a pair of vertically extending and narrowed projections 36 and 38, collectively defining a central channel between which are secured a plurality of vertically ascending and spaced apart tubular bars 40 which function as steps.

It is envisioned that the end wall 34 can be provided as a single integral piece (within which the in-molded ladder is formed) or, alternatively, can be configured at one-half sections (not shown) which are substantial minor images of each other. In each instance, the end wall section(s) include a bottom "L" channel (not shown but referenced at location 41 in FIG. 2) which is supportable upon the corresponding upwardly facing lip edge of the barge or other cargo carrying enclosure. Vertically extending strengthening ridges, see at 43, are provided for increasing the structural rigidity of the end wall 34 along the adjoining mounting locations with the edge of the end cover section 10.

Additional features include first 42 and second 44 pairs of opposite end extending eyelet portions, or lifting eyes, (see also FIG. 13) these being likewise provided along opposite extending edges associated with each interconnecting cover section and operate to facilitate release of engagement of the associated cover section with the associated lip (coaming) edge of the barge 18 and subsequent lifting/removal of that section from atop the barge. Additional rotating and "C" shaped pins (such as depicted at 46 in FIG. 2) are also secured along side edge locations of each male/female cover section and, as shown in FIG. 2, are depicted supported in a coaxial mounted relationship with the eyelet portions.

The pins 46 are likewise rotatable about a pivot portion of an associated bracket to which both the first crane engaging ring or eyelet lifting portions 42/44 and arcuately configured locking clamps (also termed pins) 46 are secured in collinear pivotal fashion. Additional locating pins or the like can be provided (not shown) which extend from underside perimeter locations of the cover and seat through aligning apertures in the perimeter lip edge of the barge, this in order to provide additional location and lateral stability during installation of the cover section and rotating engagement of the "C" pins 46.

As again best depicted in FIG. 2, the eyelet/rotating pin bracketry is built (or otherwise mechanically secured) into a reinforcing side edge disposed portion, shown as recessed edge locations 47 and 49 for the first and second extending edges, and such again including such as a heavy duty plasticized material or, in this particular instance, further potentially comprising a metal bracket or other portion integrally formed with the plasticized or PIM (powder impression molded) body. As further referenced joints within the covers may be sealed and bolted and it is further again understood that appropriate (anti-moisture admitting) ventilation is provided with respect to some or all of the cover sections in order to maintain the integrity of the contents associated with the barge.

Additional features include a pair of arcuately configured, widthwise traversable and openable/closable doors, generally referenced at 48 and 50 and for which a more detailed description will be provided with reference to FIGS. 8-11. As shown throughout the several drawings, the doors 48 and 50 each include a generally arcuate upper surface (generally matching the curvature of the associated cover section) along with four interconnected and outer perimeter defining/underside extending edges which, upon being locked in place, establish a watertight seal over the associated and opening bounding perimeter rim of the cover section. Access to the doors is afforded by integrally configured stairs, see further at 52 and 54, (these established by integrally formed series of angled interconnecting surfaces defining a stairway leading to said door) and respectively, formed into the body of each cover section and (as will be further described in additional detail in reference to succeeding figures) in order to facilitate access to the interior of the barge when the cover sections are secured in place.

As with the lifting eyes 42/44 and rotatable pins (also termed clamps) 46/48, pairs of roller supported doors 48/50 are illustrated in reference to each of the male, female and end sections shown in FIGS. 1 and 7, such that a repetitive description of which is unnecessary. It is also understood that additional variants may contemplate selected cover sections either not exhibiting an openable door or having a single door or further exhibiting a conventional hinged door design.

Figure 3:
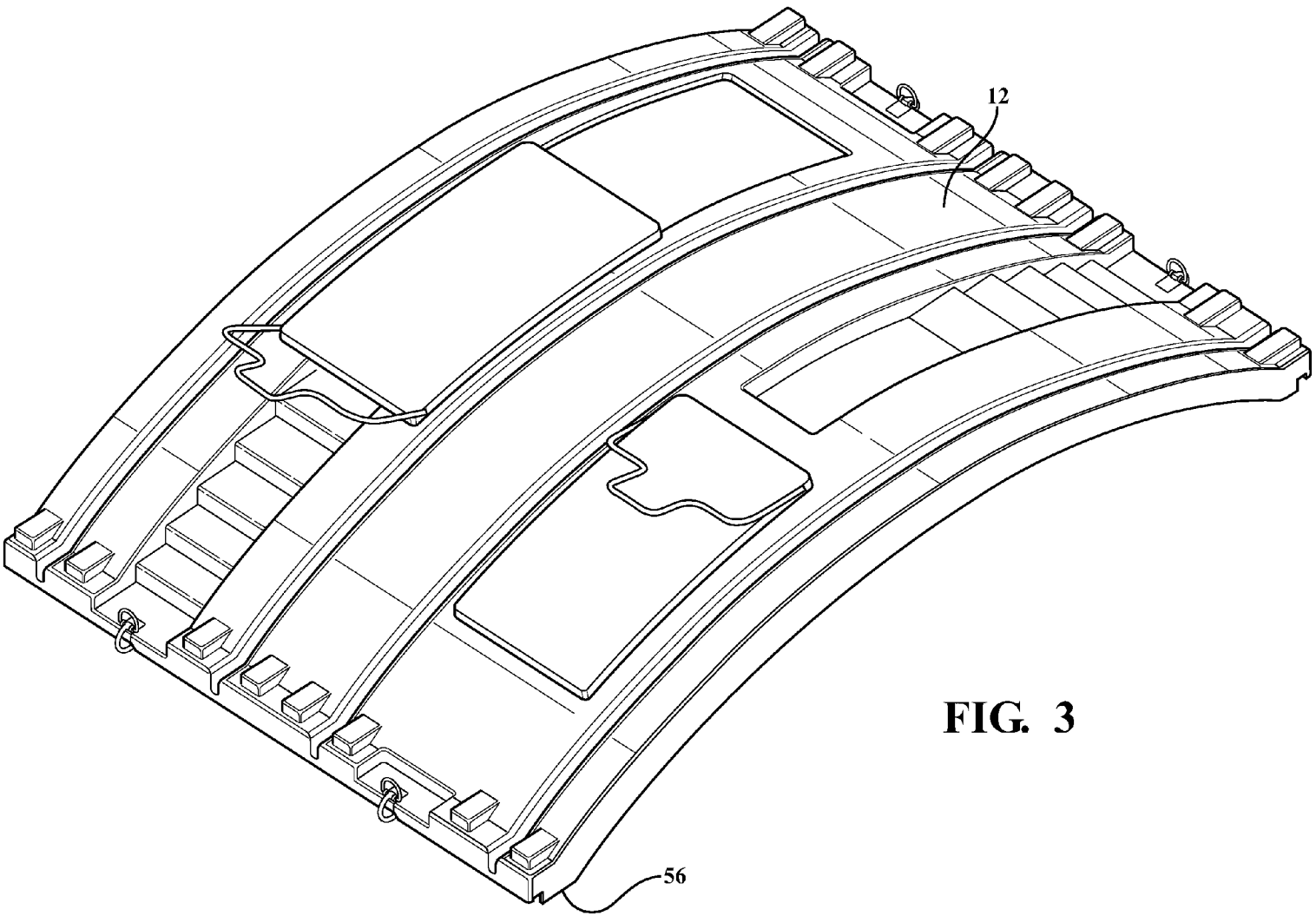
FIG. 3 is an enlarged perspective view of a selected male lid section of the assembleable cover illustrated in FIG. 1.

FIG. 3 is a perspective view of a selected male lid section, again at 12, of the assembleable cover illustrated in FIG. 1 and which includes substantially all of the identical components (not repetitively recited) associated with the end section 10 of FIG. 2, and with the exception of the end wall enclosure 34 and in-molded ladder. Likewise, FIG. 4 correspondingly presents a rotated perspective view of selected female cover/lid section 14, this again including each of the features likewise associated with the male cover section 12 of FIG. 3 and the end cover section 10 of FIG. 2.

The male cover section 12 of FIG. 3 further includes a first pair of widthwise extending and downwardly angled edges, along opposite edges and such as is visible at 56. The female cover section 14 of FIG. 4 likewise includes a second pair of widthwise extending and upwardly extending edges, see as depicted by "L" cross sectional shaped edge projections 58 and 60, and which configured so as to interengage the associated angled edges 56 of the alternately engaged male sections in a seamless and evenly mating fashion.

In this fashion, the opposing widthwise extending edge 30 of the end cover section 10 is configured similar to that exhibited by the extending edge 56 associated with the male section 12 and seats within the female extending edge 60, and in similar fashion as the male section edge 56 seating within the other female extending edge 58. Although not shown, upon assembly a plurality of underside widthwise direction extending and abutting joints are configured between both male 12 and female 14 cover sections, as well as correspondingly the male 12 to end 10 cover sections. The respective length dimensions (in the illustrated embodiment 19') and maximum height (59") of the cover sections is also referenced, and according to one preferred and non-limiting embodiment.

Figure 4:
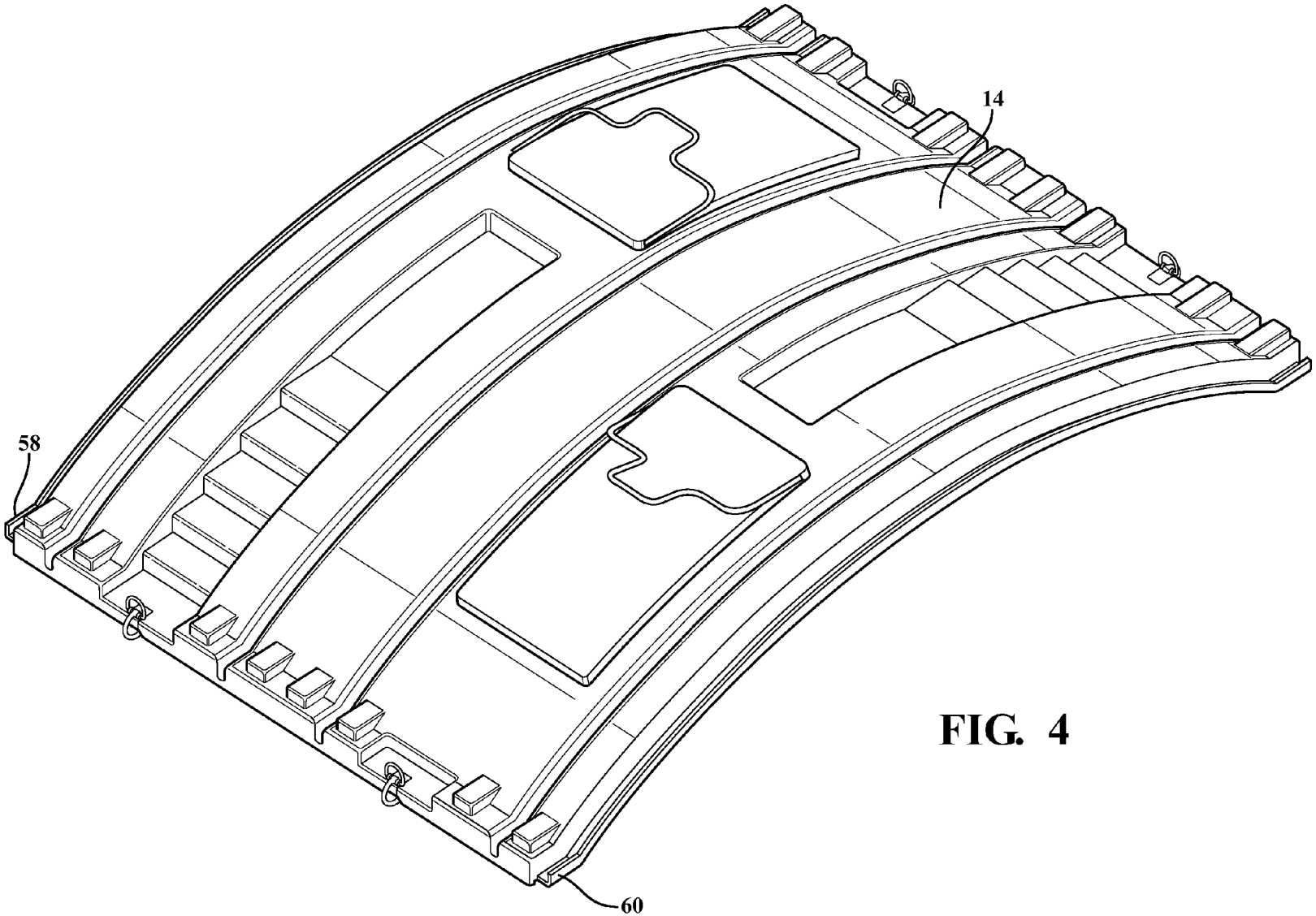
FIG. 4 is an enlarged perspective view of a selected female lid section of the assembleable cover illustrated in FIG. 1.
Figure 5:
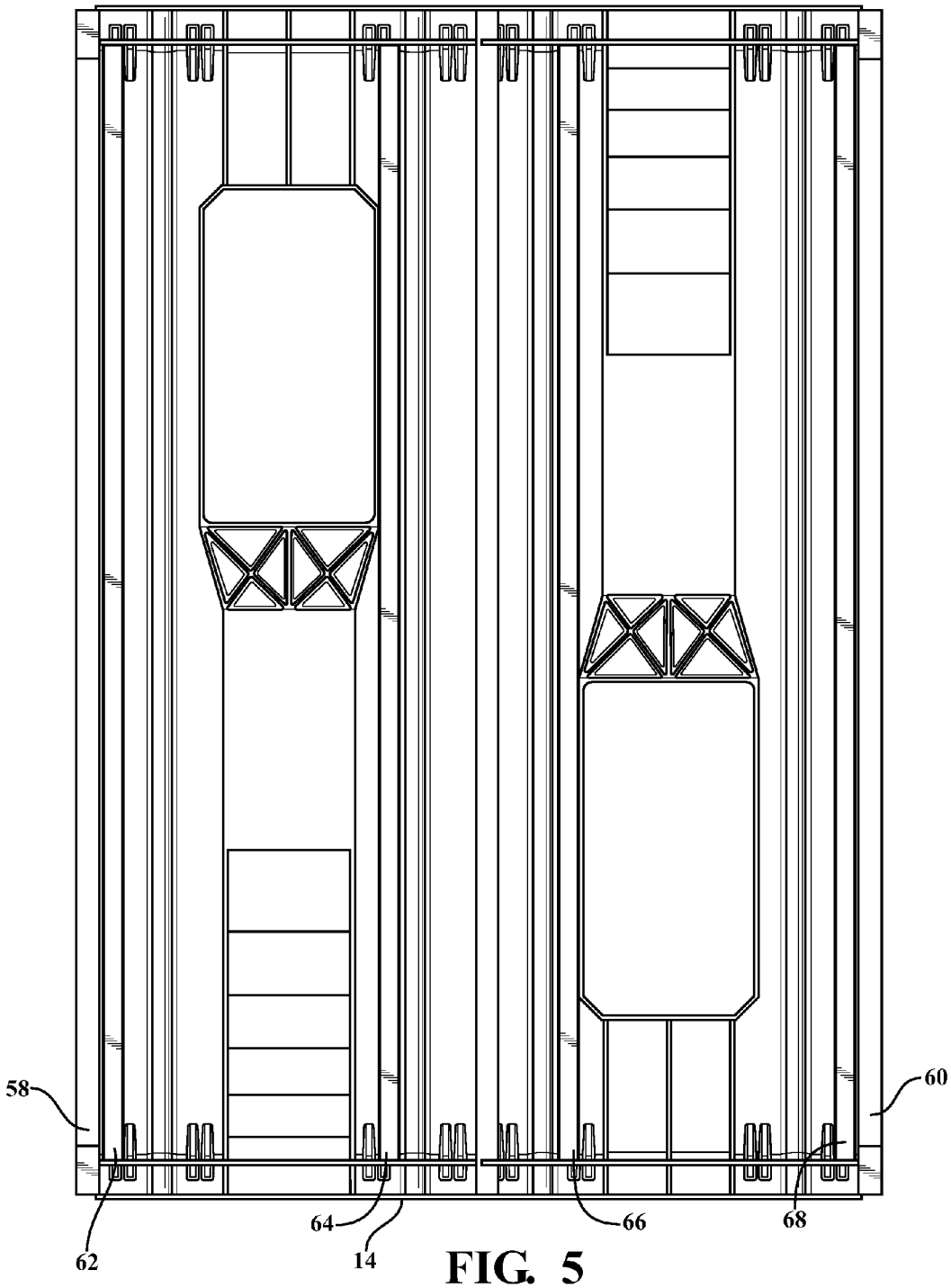
FIG. 5 is an underside plan view of a selected female lid section in FIG. 4 and better illustrating the arrangement of the four underside extending and structurally supporting trusses.
Figure 6:
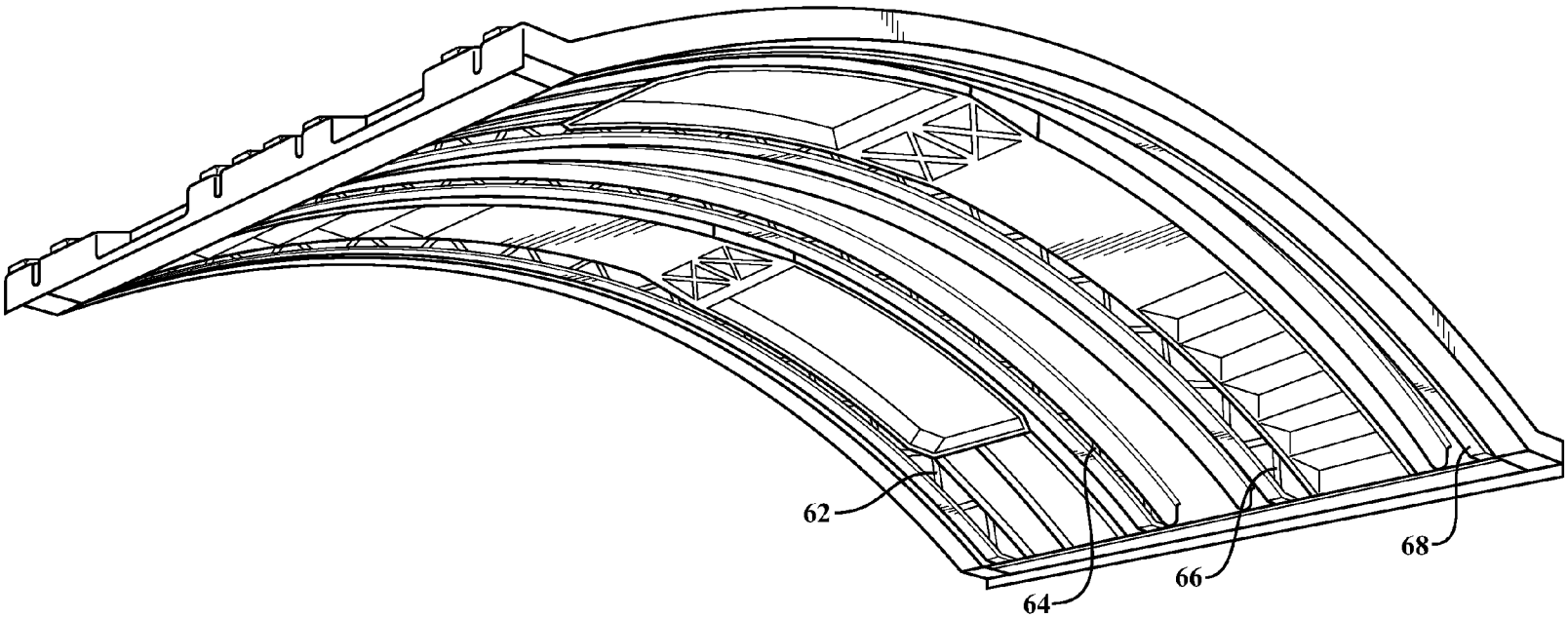
FIG. 6 is further underside perspective of a further selected male lid section and better depicting its underside profile.

Referring now to FIG. 5 an underside plan view is shown of selected female lid section 14 in FIG. 4, and better illustrating the arrangement of four underside extending and structurally supporting arcuate trusses 62, 64, 66 and 68. As further shown in reference to FIG. 6 in which an identical set of four trusses 62, 64, 66 and 68 are incorporated into a male section 12, the trusses are configured to be recess secured within the individual cover sections in a manner which provides the requisite structural reinforcing properties, while at the same time maintaining the general concave underside profile of the cover section.

Figure 10:
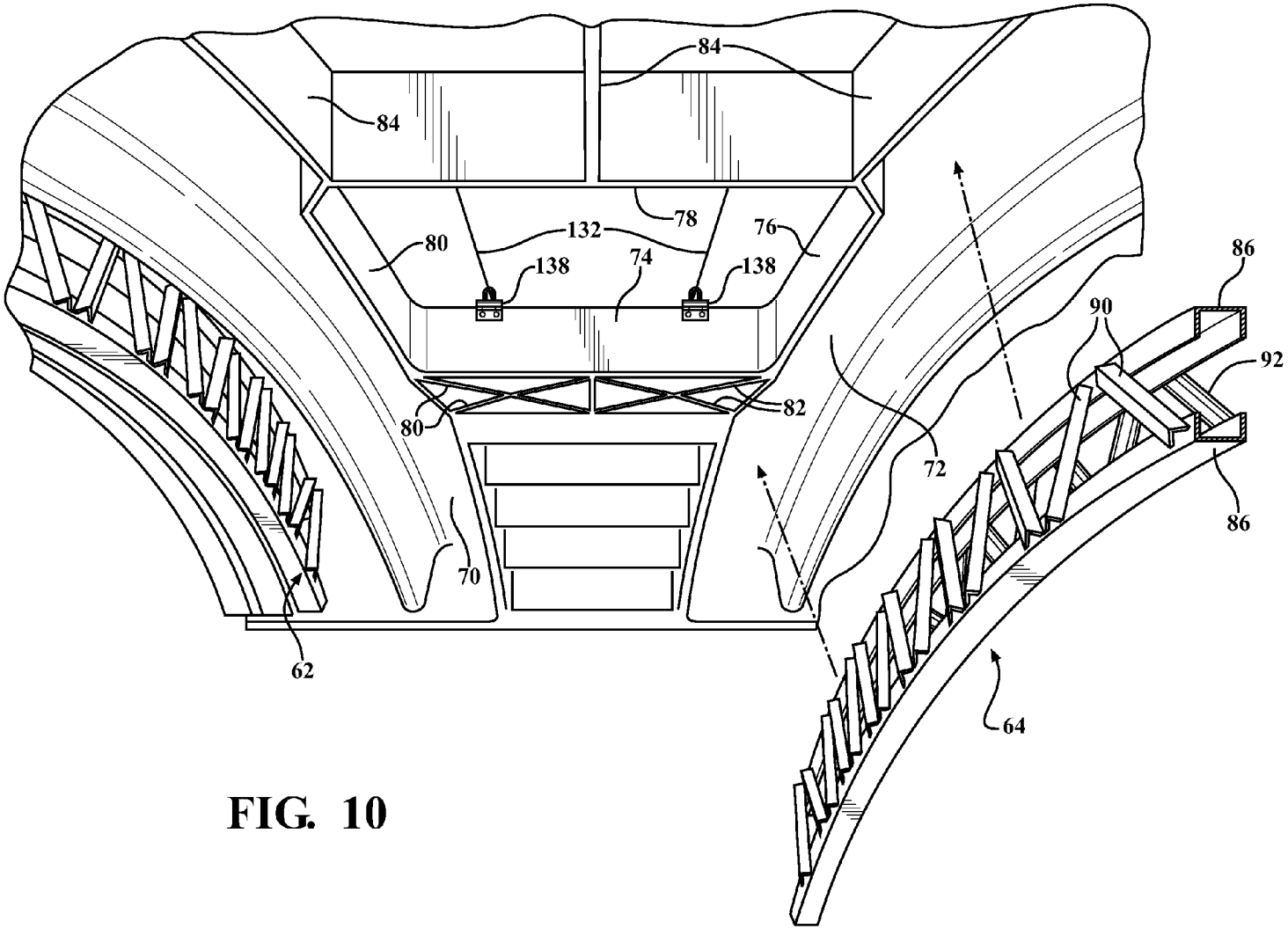
FIG. 10 is a partially exploded and underside perspective of a portion of a cover section in width extending direction and better depicting both the configuration of the door opening as well as the manner in which the truss sections are mounted to recessed underside and width extending locations of the cover.

A pair of the arcuate shaped trusses 62 and 64 (such as which can be constructed of aluminum but can also include any material such as for example carbon composites and other lightweight compositions which provide the necessary features of strength and durability) are generally depicted in the partially exploded view of FIG. 10 in relation to an indeterminate cover section and such that the trusses are mounted within arcuate recess wells or cavities 70 and 72 extending widthwise between opposite side edges and proximate a centrally located opening defined by in-molded and interconnecting perimeter walls 74, 76, 78 and 80. Referring again to FIG. 10, additional structural ribbing and in molded supports are further generally referenced at 80, 82, 84, et seq. across the inner and underside of each cover section and which establishes the necessary structurally supporting characteristics which make possible both the lifting, transport and stacking of the individual cover sections as well as the ability to withstand the forces of one or more individuals walking upon the cover section, such as during opening/closing of the doors 48/50.

The trusses are constructed according to one possible configuration and, as best depicted by selected truss 64 in FIG. 10, include a pair of opposing, spaced apart and arcuate extending "U" cross shaped tracks or end supports 86 and 88. These are secured and reinforced by individual pluralities of opposite edge inter-extending and angled brackets (see "L" cross sectional shaped brackets 90 and 92 on opposite sides of the "U" shaped tracks 68 and 88) and which are welded to the respective facing sides of the upper and lower tracks 86 and 88.

Figure 8:
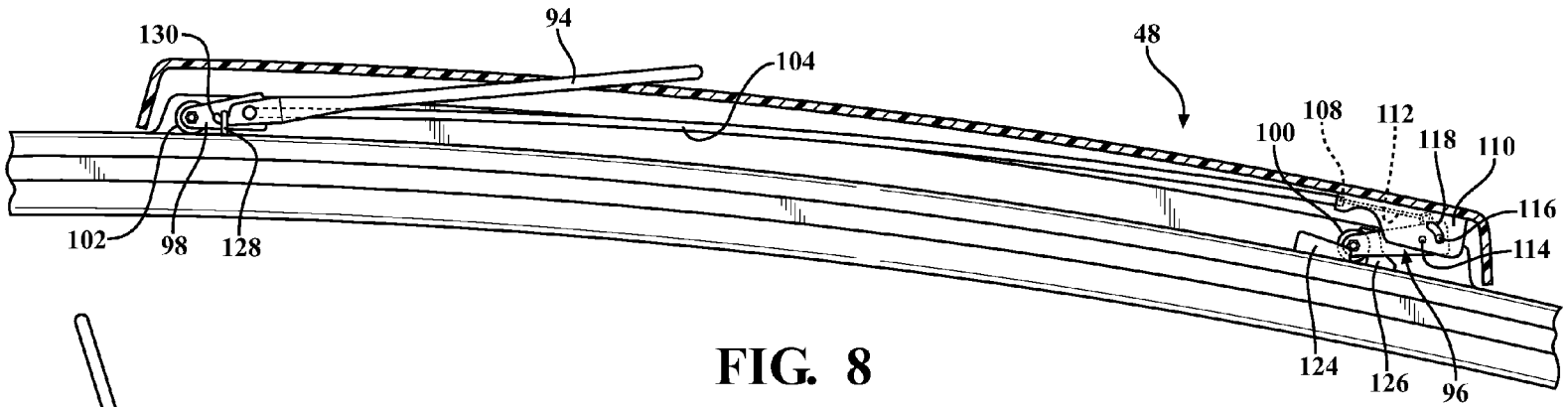
FIG. 8 is a partial side view of a selected door sub-assembly with four point locking feature illustrated in a first position with the handle in a closed folded/locking position.

Referring now to FIG. 8, a partial side view is shown of selected door sub-assembly 48 with four point locking feature and illustrated in a first position with a pivotally associated and locking handle 94 in a closed folded/locking position. With additional reference to FIGS. 10 and 11, the construction of the door sub-assembly includes a first remote end located pair of legs (shown by leg 96 in FIG. 8) which are pivotally secured to an underside of the cover section, along with a second handle end actuated pair of pivotal legs (further shown by selected leg 98).

A roller is supported at a remote end of each pivotal leg, see at 100 for leg 96 and at 102 for leg 98. Synchronized pivoting of each opposite end located pair of legs 96 and 98 is assisted by a width extending actuation bar or rod 104 which, as shown in FIGS. 8 and 9, and which is connected at a first end 106 to an inner end location of the pivotal leg 98 a spaced distance from the lower exposed roller 102.

The linear actuation rod 104 is further connected at an opposite second end 108 to a support bracket 110 to which the remote pivoting leg 100 is secured. A cable or the like (see in phantom at 112 in FIGS. 8 and 9) extends from the remote end 108 of the rod and engages a likewise elevated location of the leg 96 located above its pivot point 114 to the bracket 110 and opposite the exposed end supported roller 100.

Figure 9:
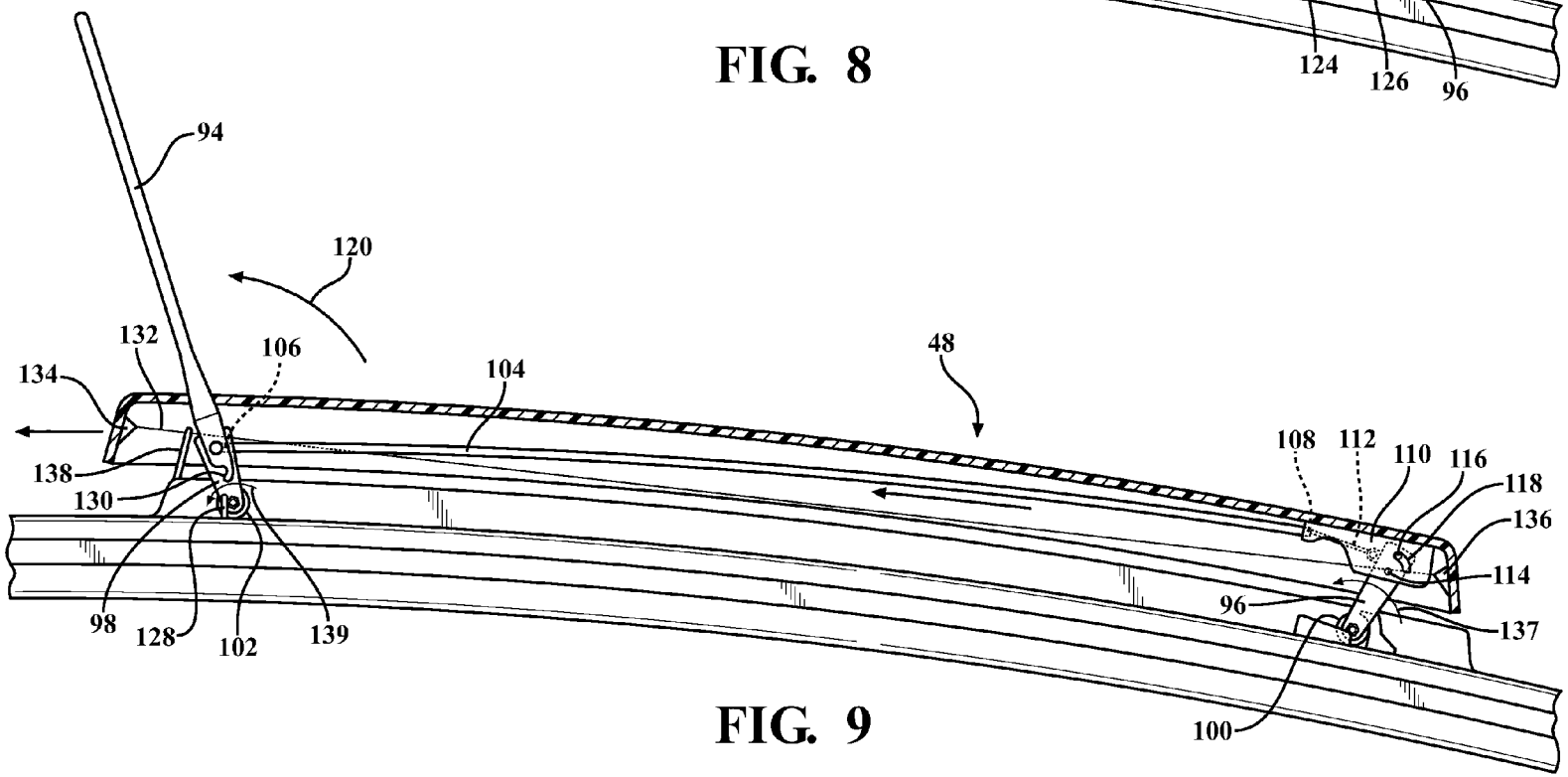
FIG. 9 is a succeeding view to FIG. 8 illustrating the handle in an upwardly rotated and opened/unlocking position in which the door is elevated in unseating fashion from the perimeter extending portion of the cover surrounding the opening over which the cover seats in the closed position, and which permits the cover to be subsequently transported by an operator pulling on the handle to fully reveal the opening.

A pin 116 extending laterally from the leg 96 seats within a channel 118 defined in the bracket 110 in order to establish a range of pivotal motion of the leg 96 as depicted in FIGS. 8 and 9, this occurring in synchronized fashion with the upward rotation of the handle 94 as depicted by arrow 120 in FIG. 9. Additional reference to FIG. 11 further assists in explaining the four point locking feature provided at each cover section corner proximate the depicted doorway opening and includes a pair of forward and remote end located engaging brackets 122 (corresponding to pivotal legs 96 in the locked position), these not to be understood with the leg support brackets 110 previously described.

Figure 11:
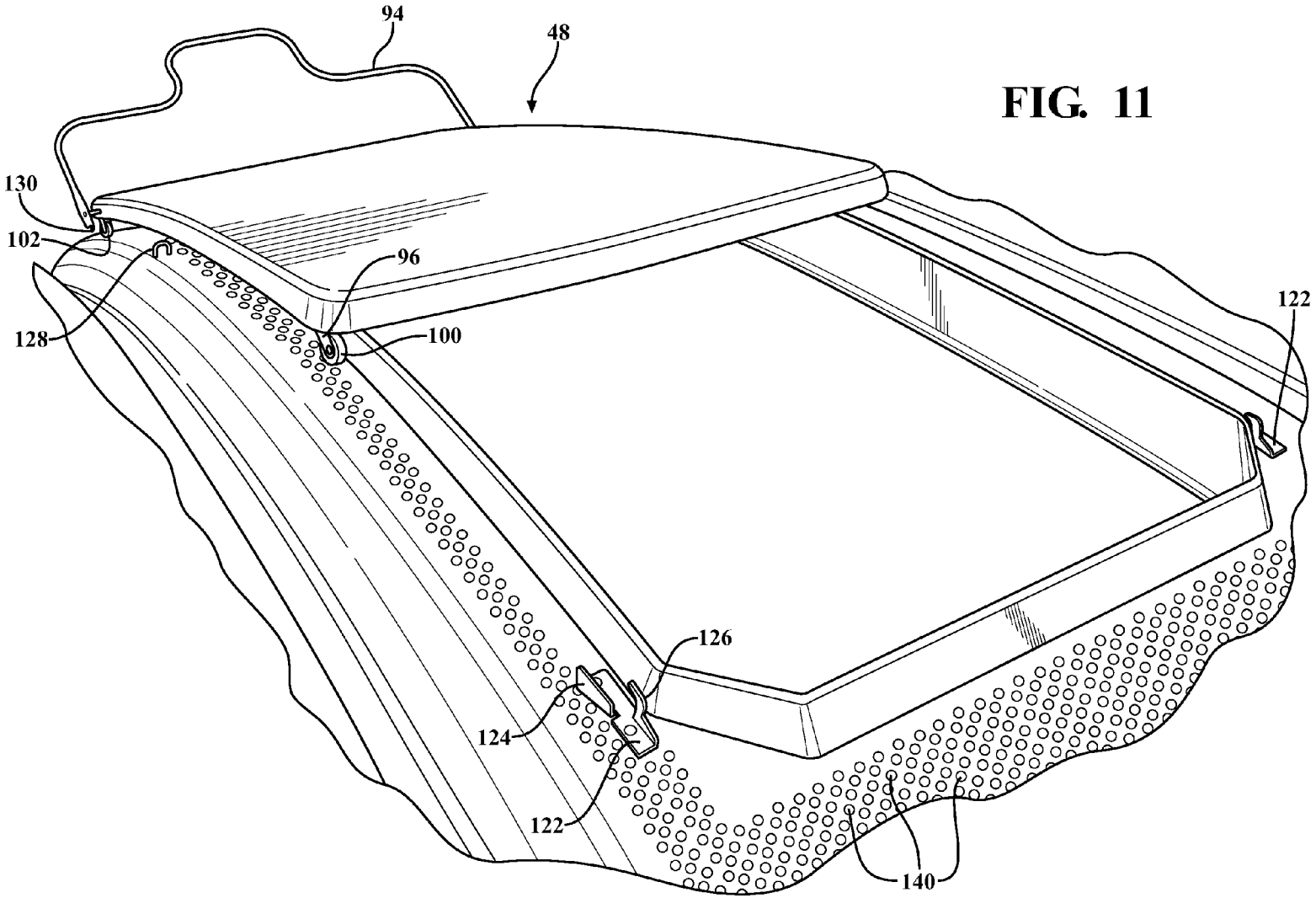
FIG. 11 is an upper partial perspective of a cover section and illustrating the door in the position of FIG. 9 in an open pulled/traversed location.

The brackets 122, as depicted by the more visible one shown in FIG. 11, includes an outer and upwardly extending flange or wall 124 (the purpose for which being to located and seat the roller 100 upon the door being pushed to the closed position. An inner spatially offset and fixed hook 126 is further shown and which is located and dimensioned so that it seats through an aperture (not shown but readily evident from FIG. 8) in the pivotal leg 96 proximate the end supported roller 100. In this fashion, the outer flange 124 and inner hook 126 collectively define a first pair of forward locking locations for the door subassembly and between which a passageway is established for receiving the roller 100 as again shown in FIG. 8.

A further and opposite end pair of locking locations is assisted by a pair of "U" shaped catch locations 128 (one of which is shown in perspective in FIG. 11) projecting from perimeter established locations of the cover section proximate the inner defined opening. The ends of the pivotal handle 94 further depict an arcuate extending finger 130 which, in the forwardly folded and locking position established by the handle 94 in FIG. 8, is seated and engaged through the catch locations 128.

As further best depicted in FIG. 9 (which shows the cover in the slightly elevated position relative to the perimeter opening of the cover section) additionally shown are a pair of inner located and width extending cables or guide lines (these depicted by guide lines or cables 132 which extends between opposite and inwardly facing end locations 134 and 136 of the door 48. To assist in providing lateral stability of the door 48 as it translates between the open and closed positions, as well as to prevent the door from becoming disengaged between the open and closed positions, the cables are seated through a pair of doorway perimeter secured and pivotal eye brackets, see at 138 in FIG. 10, and such that they guided and restrain the cables 132 all along the range of opening/closing. Upon fully opening the door, the remote end location 136 of the cable further engages the eye bracket 138 and, upon rotating the pivot handle 94 downwardly, engages the bracket 138 to a sufficient degree to maintain the door in the open position relative to the cover defined opening and for as long as is desired.

In this fashion, and upon the handle 94 being upwardly rotated from the position depicted in FIG. 8, the interconnected pairs of legs 96 and 98 and concurrently rotated in a counter clockwise direction, see arrows 137 and 139 in FIG. 9. At this point, the finger 130 unseats from the "U" catch locations 128 simultaneously with the synchronized pivoting remote legs 96 unseating from the remote end located hooks 126, the door 48 (and in particular its underside perimeter edge) being elevated in unseating fashion from the perimeter extending portion of the cover surrounding the opening and over which the cover seats in the closed position. At this point, and as further depicted by the intermediate opened position in FIG. 11, the cover may be transported by an operator pulling on the handle (such as during walking along the integrally formed stairway) and, upon being fully traversed, revealing the opening at which the handle 94 is rotated closed so that the remote end locations 136 of the cables 132 engage the eye brackets 138.

As further illustrated in FIG. 11, the exterior surfaces of each of the male/female/end cover sections exhibit roughened (anti-skid) exterior surfaces, such as shown at 140, for providing a slip resistant surface during such as the assembly/ locking of the individual cover sections, as well as walking along a top of the cover sections and opening and closing of the roller supported doors.

Although not further shown, an additional feature of the present design is the ability to stack a plurality of the buoyant and lightweight cover sections (any combination of male, female or end), such as which are then easy to transport or store according to the wishes of the user.

Having described my invention, other and additional preferred embodiments will become apparent to those skilled in the art to which it pertains, without deviating from the scope of the appended claims:

We claim:

1. A cover exhibiting a plasticized construction for use with an elongated and inner perimeter defined opening associated with a transportable barge, said cover comprising:

a body constructed from a plurality of assembleable cover sections extending in both widthwise and lengthwise fashion relative to an edge defining an open perimeter of the barge, said plurality of cover sections including first and second end sections and intermediately defined and alternating female and male sections arranged in joint abutting fashion, said male cover sections each exhibiting first extending edges along each of opposite ends, alternating female cover sections each exhibiting second extending edges which locate and engage said male extending edges;

a plurality of perimeter edge locations brackets defined along side edge locations of each cover section and including at least one of opposing pairs of lifting eyes and locking pins and adapted for either securing said cover section upon the barge perimeter defining edge or for lifting the cover section off of the barge; and at least one door subassembly traversable over an opening defined in at least one cover section and exhibiting a four point locking and sealing arrangement in a closed position, a pivot handle connected to said door and, upon rotating upwardly, unseating said door from a perimeter edge of the cover in an upwardly displacing and opening position to permit said door to be transported away from the opening for accessing a cargo carrying interior associated with the barge.

2. The cover as described in claim 1, further comprising a plurality of arcuate trusses incorporated into recessed and width extending undersides of each cover section.

3. The cover as described in claim 2, said trusses further comprising a pair of opposing, spaced apart and arcuate extending U-shaped tracks, individual pluralities of opposite edge inter-extending and angled brackets engaging opposite sides of said U-shaped tracks.

4. The cover as described in claim 1, said door subassembly further comprising a first remote end located pair of legs pivotally secured to an underside of the cover section in cooperation with a second handle end actuated pair of pivotal legs, a roller supported at a remote end of each pivotal leg.

5. The cover as described in claim 4, further comprising synchronized pivoting of each opposite end located pair of legs assisted by a width extending actuation rod which is connected at a first end to an inner end location of a first selected pivotal leg connected to an end of said handle and at an opposite second end to a support bracket to which said remote pivoting leg is secured, a cable extending from a remote end of said rod and engaging said leg above its pivot point to said bracket.

6. The cover as described in claim 5, further comprising a pin extending laterally from said remote pivoting leg and seating within a channel defined in said bracket in order to establish a range of pivotal motion in synchronized fashion with dual pairs of rotating legs during upward rotation of said handle.

7. The cover as described in claim 4, further comprising a pair of forward and remote end located engaging brackets for engaging said remote pair of pivotal legs, said engaging brackets each including an outer and upwardly extending flange for locating and seat said roller upon said door being pushed to the closed position, an inner spatially offset and fixed hook being located and dimensioned so that it seats through an aperture in said pivotal leg proximate said end supported roller, said outer flange and inner hook collectively defining a first pair of forward locking locations for the door subassembly and between which a passageway is established for receiving said roller.

8. The cover as described in claim 7, further comprising an opposite end pair of locking locations including a pair of U-shaped catch locations projecting from perimeter cover locations around the opening, ends of said pivotal handle further depicted by an arcuate extending finger which, in the forwardly folded and locking position established by said handle, is seated and engaged through said catch locations.

9. The cover as described in claim 8, further comprising a pair of inner located and width extending cables which extends between opposite and inwardly facing end locations of said door, said cables seating through a pair of doorway perimeter secured and pivotal eye brackets such that said eye brackets guide and restrain said cables all along the range of opening and closing of said door.

10. The cover as described in claim 9, whereupon fully opening the door, said door subassembly further comprising said remote end locations of said cable engaging said eye bracket and, upon rotating said pivot handle downwardly, engaging said eye bracket to a sufficient degree to maintain the door in the open position relative to the cover defined opening.

11. The cover as described in claim 1, further comprising an arcuate end wall secured to each of said end sections and into which is integrally formed a step ladder.

12. The cover as described in claim 1, further comprising a pair of vertically extending and narrowed projections integrally projecting from exterior locations of said end wall and collectively defining a central channel between which are secured a plurality of vertically ascending and spaced apart tubular bars.

13. The cover as described in claim 1, each of said cover sections exhibiting a specified shape and size with an arcuate extending upper edge into which is integrally formed a stairway leading to said roller supported door.

14. The cover as described in claim 1, each of said doors exhibiting an overall width extending arcuate shape with an underside perimeter extending edge which seals against a perimeter location of the cover section around the opening.

15. The cover as described in claim 1, each of said cover sections exhibiting a specified shape and size and including exterior textured and skid-proof surfaces.

16. A cover for use with an elongated and inner perimeter defined opening associated with a transportable barge, said cover comprising:

a body including a plurality of interconnected sections extending in both widthwise and lengthwise fashion relative to an edge defining an open perimeter of the barge and including first and second end portions and intermediately defined and alternating female and male sections arranged in joint abutting fashion, said male cover sections each exhibiting first extending edges along each of opposite ends, alternating female cover sections each exhibiting second extending edges which locate and engage said male extending edges;

a plurality of perimeter edge locations brackets defined along side edge locations of each cover section and including at least one of opposing pairs of lifting eyes and locking pins and adapted for either securing said cover section upon the barge perimeter defining edge or for lifting the cover section off of the barge;

a plurality of arcuate trusses incorporated into recessed and width extending undersides of each cover section;

at least one door subassembly incorporated into each section and traversable over interior openings defined in said sections, each of said door subassemblies further comprising a pivot handle connected to an end of said door and, upon rotating upwardly, unseating said door from a perimeter edge of the cover in an upwardly displacing and opening position to permit said door to be transported away from the opening for accessing a cargo carrying interior associated with the barge; and an integrally formed stairway extending in a widthwise direction and leading to said door subassembly.

* * * * *